US009521880B2

(12) United States Patent
Nealon

(10) Patent No.: US 9,521,880 B2
(45) Date of Patent: Dec. 20, 2016

(54) BELT BUCKLE

(71) Applicant: Christopher T. Nealon, Saugerties, NY (US)

(72) Inventor: Christopher T. Nealon, Saugerties, NY (US)

( * ) Notice: Subject to any disclaimer, the term of this patent is extended or adjusted under 35 U.S.C. 154(b) by 857 days.

(21) Appl. No.: 13/765,439

(22) Filed: Feb. 12, 2013

(65) Prior Publication Data

US 2013/0205552 A1 Aug. 15, 2013

Related U.S. Application Data

(60) Provisional application No. 61/598,178, filed on Feb. 13, 2012.

(51) Int. Cl.
*A44B 11/22* (2006.01)
*A44B 11/04* (2006.01)

(52) U.S. Cl.
CPC ..... *A44B 11/04* (2013.01); *A44B 11/22* (2013.01); *Y10T 24/2192* (2015.01); *Y10T 24/4091* (2015.01)

(58) Field of Classification Search
CPC ..... Y10T 24/4026; Y10T 24/4033; Y10T 24/4093; A44B 11/22; A44B 11/04
See application file for complete search history.

(56) References Cited

U.S. PATENT DOCUMENTS 67,428 A * 8/1867 Gerard ..... A44B 11/04 2/268
489,656 A 1/1893 Moores
730,551 A 6/1903 Moores
879,077 A * 2/1908 Young ..... A44B 11/22 24/176
1,860,170 A * 5/1932 Bronson ..... A44B 11/04 24/198
1,999,168 A 4/1935 Erb
2,268,738 A 1/1942 Chenette
2,495,029 A 1/1950 Spengler
2,663,062 A * 12/1953 Abel ..... A44B 11/22 24/163 R
2,809,410 A * 10/1957 Reiter ..... A44B 11/04 24/163 R (Continued)

FOREIGN PATENT DOCUMENTS

FR 2315027 A2 1/1977

OTHER PUBLICATIONS

International Search Report and Written Opinion of the International Searching Authority Application No. PCT/US2013/025886 Completed: Apr. 2, 2013; Mailing Date: Apr. 18, 2013 9 pages.

(Continued)

*Primary Examiner* — Shaun R Hurley
*Assistant Examiner* — Andrew W Sutton
(74) *Attorney, Agent, or Firm* — St. Onge Steward Johnston & Reens, LLC

(57) ABSTRACT

A belt and belt buckle design that opens to the front where the strap enters the belt buckle from below. The buckle is made from a single buckle member that is formed and that uses force and/or guidance from the buckle to hold the belt in place. The buckle has a hook region to support the strap of the belt and has a body passing around the strap from the back region of the strap to the front region of the strap.

26 Claims, 7 Drawing Sheets

(56) References Cited

U.S. PATENT DOCUMENTS

| | | | | |
|---|---|---|---|---|
| 3,440,667 | A | 4/1969 | Dye | |
| 4,173,794 | A | 11/1979 | Nichols | |
| 7,520,031 | B2 | 4/2009 | Dahl | |
| 2004/0093700 | A1* | 5/2004 | Frangesh | A44B 11/04 24/169 |
| 2007/0193003 | A1 | 8/2007 | Matusek et al. | |
| 2013/0205552 | A1* | 8/2013 | Nealon | A44B 11/22 24/68 E |
| 2015/0033518 | A1* | 2/2015 | Moritz | A44B 11/04 24/68 E |

OTHER PUBLICATIONS

Narragansett Leathers Hoof Pick Belt; © 2013; Webpage http://www.narragansettleathers.com/HoofPickBelt.html; 3 pages.
Martin Faizey Belt Design; Webpage: http://global.rakuten.com/en/store/three-eight/item/martin-faizey-mesh-belt-havana/; 6 pages.
Narragansett Leathers Pelican Hook Belt; Webpage: http://www.narragansettleathers.com/PelicanHookBelt.html; © 2013; 3 pages.
Hickoree's Trace Carrier Belt; Webpage: http://www.hickorees.com/brand/leather-man-ltd/product/trace-carrier-belt-dark-brown; 1967; 3 pages.

* cited by examiner

BELT BUCKLE

FIELD OF THE INVENTION

The invention is directed to a single member buckle design that, when opened to the front (away from the body of wearer), allows the belt strap to enter or exit the buckle from below (or above when belt is threaded in the opposite direction through the belt loops of trousers).

BACKGROUND OF THE INVENTION

Belt buckles are well known. Typical belt buckles include a strap and a belt buckle, the belt strap extending through the belt buckle to engage the strap with the belt buckle. Such engagement holds the belt in place around the waist of a person and can be used to support the weight of a person's pants.

Typical belt buckle designs involve a closed square, rectangular or oval metal loop wherein the proximal end is attached to one side of the closed loop or around an intermediate member of that closed loop buckle that has a rod or pin that fits through a hole in the strap to engage the belt buckle to the strap. Typical straps have multiple holes so that the engagement of the belt buckle to the strap can be adjusted to fit various waist sizes. Typical belt buckle designs have more than one piece. Typical belt buckle designs have two or more moving parts.

Belt designs known in the art include the "Hoof Pick Belt" and the "Pelican Hook Belt" made by Narragansett Leather Co., which have a hook action belt buckle and are open framed in appearance. Neither design has the option of feeding the strap from below and neither buckle is constructed from a single member. Instead, these designs are constructed of a closed loop that is attached to the proximal end of the strap.

Other designs, such as the "Trace Carrier Belt" by Leather Man Ltd. is an example of a single member buckle with no moving parts but is a closed loop construction that does not allow access from below.

Other belt buckle designs include the typical square or oval metal plate buckle of the ilk seen worn by adherents of American Western style. These buckles often display a scene or a steer's head. Such buckles share a hook for engaging the belt hole that protrudes from the backside of the buckle and is bent back towards the body of the buckle to enhance positive engagement. In these buckles the structural body lies above the strap being hooked and holds the strap down.

However, prior art belt buckle designs are of closed loop construction and do not allow for the strap to enter the belt buckle from below. As hereinafter defined, the "front" of the belt buckle is being away from the body of the wearer. "Below" is hereinafter defined as being within the vertical plane relative to the front of the wearer.

It is desirable to provide a belt buckle design that allows the strap to enter the belt buckle from below and has the belt buckle made from a single piece or is of a one-piece design. Such a design is an elegant solution that is easy to manufacture as the belt buckle, in its simplest form, is constructed from a single length member.

SUMMARY OF THE INVENTION

It is an object of the present invention to provide a belt buckle design that allows the strap to enter the belt buckle from below. It is another object of the present invention to provide a belt buckle where the belt buckle is constructed into a single member allowing for any shape or profile or method of formation (e.g. laser cut plate).

These and other objects of the invention are achieved by providing a belt comprising: a strap, the strap comprising a proximal end and a distal end, the proximal end of the strap having an engagement region and the distal end of the strap having at least one hole, the strap having a front side and a back side; and a buckle member, the buckle member being formed and having a proximal section, a middle section and a distal section, the proximal section of the buckle member passing through the engagement region of the proximal end of the strap to engage the buckle member to the strap, the proximal section of the buckle member having a hook region that provides support for the distal end of the strap, the middle section of the buckle member passing around the distal section of the strap from the back region of the strap to the front region of the distal end of the strap, and the distal section of the buckle member passing in the front region of the distal end of the strap, the distal section of the buckle member engaging the at least one hole on the distal end of the strap. In some embodiments, the engagement of the buckle member passing through the proximal end of the strap is permanent.

The buckle member may be a rod, which is round, or may be a flat or square stock. The buckle member may be a shape formed from a larger piece of stock material and then formed. The buckle member may be open and curved. The buckle member may be made of a single or one-piece. In certain embodiments, the buckle member is forged from one material, such as a metal, so that it is one continuous piece.

The distal end of the strap may enter the buckle member from below. The distal end of the strap may be held in place by the middle section of the buckle member and the proximal section of the buckle member from which the buckle is comprised.

In some embodiments, the hook region in the proximal section of the buckle member exerts an upward force on the distal end of the strap, and the middle section of the buckle member passes around the distal section of the strap from the back region of the strap to the front region of the strap and provides a force on the distal end of the strap to hold the distal end of the strip in place. In other embodiments, the middle section of the buckle member provides force and guidance to the distal end of the strap to hold the distal end of the strap in place. In some embodiments, the force applied is to the front of the strap.

In some embodiments, the proximal section of the buckle member having a hook region involves the hook region having a right angle bend, wherein the hook region passes around the distal section of the strap from the back region of the distal end of the strap to the front region of the distal end of the strap.

In some embodiments, the proximal hook region rotates into the aforesaid engaged position by attaching the hook at the distal end of the buckle into the one of the at least several holes in the distal end of the strap.

In some embodiments, the proximal hook region is raised from a position parallel to the front surface of the strap, allowing easy entry into the buckle, to a position perpendicular to the front surface of the strap, effectively locking the strap into position.

In some embodiments, the remainder of the proximal section of the buckle member passes through the engagement region at the proximal end of the strap.

In some embodiments, the middle section of the buckle member passes from the back region of the distal end of the strap to the front region of the distal end of the strap on a radius of approximately 180 degrees.

In some embodiments, the middle section of the buckle member passes approximately 45 degrees from the plane of the initial right angle bend in the proximal section of the buckle member.

In some embodiments, the remainder of the middle section of the buckle member is a radius semicircular curve that passes in the front region of the distal end of the strap.

In some embodiments, the remainder of the middle section of the buckle member is formed so that it passes in the front region of the distal end of the strap in a manner to provide sufficient force towards the face of the distal end of the strap to prevent the strap from moving away from the body of the wearer or slipping over the right angle hook at the end of the proximal section of the buckle when buckle is engaged.

In some embodiments, the middle section of the buckle member comprises a radius semicircular curve that terminates with another bend away from the middle section of the buckle, which sends the distal section of the buckle member in a direction parallel to the center line of the distal end of the strap.

In some embodiments, the distal section of the buckle member has a one hundred and five degree or an approximately one hundred and five degree bend formed in the direction of the front of the strap, the distal section of the buckle member having a hook to engage the at least one hole in the distal end of the strap. In other embodiments, the distal section of the buckle member has a ninety or an approximately ninety degree bend formed in the direction of the front of the strap, the distal section of the buckle member having a hook to engage the at least one hole in the distal end of the strap.

In some embodiments, the distal end of the strap has a plurality of holes. In some embodiments, the buckle member is made from a metal or a metal alloy.

In some embodiments, the distal section of the buckle member has a tip with decreasing diameter. In some embodiments, the distal section of the buckle member has a tip with a non-decreasing diameter. In some embodiments, the distal end of the strap can be slid into the buckle member at any point along the strap prior to engagement.

Other objects of the invention are achieved by providing a belt comprising: a strap, the strap comprising a proximal end and a distal end, the proximal end of the strap having an engagement region and the distal end of the strap having at least one hole, the strap having a front side and a back side; and a buckle, the buckle being curved and having a proximal section and a distal section, the proximal section of the buckle passing through the engagement region of the proximal end of the strap to permanently (or semi-permanently if the strap is attached with snaps) engage the buckle to the strap, the proximal section of the buckle having a hook region that provides support for the distal end of the strap, the distal section of the buckle being open, the distal section of the buckle passing around the distal section of the strap from the back region of the strap to the front region of the distal end of the strap, the distal section of the buckle engaging the at least one hole on the distal end of the strap.

Other objects of the invention are achieved by providing a belt buckle comprising: a buckle member, the buckle member being one piece and being formed, the buckle member divided into a proximal section, a middle section and a distal section, the proximal section of the buckle member able to pass through the engagement region of a proximal end of strap to engage the buckle member to the strap, the proximal section of the buckle member having a hook region, the middle section of the buckle member being open and curved, and the distal section of the buckle member able to engage at least one hole on the distal end of the strap. In some embodiments the buckle member is curved.

Other objects of the invention are achieved by providing a belt buckle comprising: a buckle member, the buckle member being one piece and being formed, the buckle member divided into a proximal section, a middle section and a distal section, the proximal section of the buckle member able to pass through the engagement region of a proximal end of strap to engage the buckle member to the strap, the proximal section of the buckle member having a hook region providing a stop for the proximal strap attachment to the buckle and a stop that rotates into perpendicular position preventing downward movement in the direction below the buckle, the middle section of the buckle member being open and formed in a way to control the distal end of the strap from moving away from the body of the wearer by creating barrier exerting a force towards the body of the wearer and the distal section of the buckle member able to engage the at least one hole on the distal end of the strap.

Other objects of the invention are achieved by providing a belt comprising: a strap, the strap comprising a proximal end and a distal end, the distal end of the strap having at least one hole, the strap having a front side and a back side; and a buckle member, the buckle member having a proximal section and a distal section, the proximal section of the buckle member being formed and engaging the buckle member to the strap, the proximal section of the buckle member having a hook region that provides support for the distal end of the strap and having a body passing around the distal section of the strap from the back region of the strap to the front region of the distal end of the strap, and the distal section of the buckle member passing in the front region of the distal end of the strap, the distal section of the buckle member engaging the at least one hole on the distal end of the strap.

In some embodiments, the distal end of the strap enters the buckle member from below.

In some embodiments, the distal end of the strap is held in place by the distal section of the buckle member and the proximal section of the buckle member.

In some embodiments, the hook region in the proximal section of the buckle member exerts an upward force on the distal end of the strap, and wherein the proximal section of the buckle member passing around the distal section of the strap from the back region of the strap to the front region of the strap provides a force on the distal end of the strap to hold the distal end of the strip in place.

In some embodiments, the proximal section of the buckle member having a hook region involves the hook region having a right angle bend, wherein the hook region, when the buckle is engaged, passes below the distal section of the strap from the back region of the distal end of the strap to the front region of the distal end of the strap.

In some embodiments, the proximal hook region rotates into the aforesaid engaged position by attaching the hook at the distal end of the buckle into the one of the at least several holes in the distal end of the strap.

In some embodiments, the proximal hook region is raised from a position parallel to the front surface of the strap, allowing easy entry into the buckle, to a position perpendicular to the front surface of the strap, effectively locking the strap into position.

In some embodiments, the distal section of the buckle member is a rod extending in a direction parallel to the center line of the distal end of the strap.

In some embodiments, the distal section of the buckle member is rectangular and extends extending in a direction parallel to the center line of the distal end of the strap.

In some embodiments, the distal section of the buckle member is tapered as its passes along the front region of the distal end of the strap.

In some embodiments, the distal end of the strap can be slid into the buckle member at any point along the strap prior to engagement.

Other objects of the invention are achieved by providing a buckle member, the buckle member being formed and engaging the buckle member to a strap, the proximal section of the buckle member having a hook region that provides support for the distal end of the strap and having a body passing around the distal section of the strap from the back region of the strap to the front region of the distal end of the strap.

Other objects of the invention are achieved by allowing for the interplay of different portions of the buckle, which function together to control the distal end of the strap when engaged, yet still allow the user to take advantage of the flexible nature of the strap during engagement and disengagement. The interplay of these variables, namely, (1) the bend below the strap's proximal point of attachment to the buckle, (2) the proximity of the portion of the buckle that lies in front of the strap to the prior mentioned bend and, (3) the adjustment of that proximity in consideration of the flexibility of the strapping material allow an improved buckle and belt design to be achieved.

Other objects of the invention and its particular features and advantages will become more apparent from consideration of the following drawings and accompanying detailed description. It should be understood that the detailed description and specific examples, while indicating the preferred embodiment of the invention, are intended for purposes of illustration only and are not intended to limit the scope of the invention.

DETAILED DESCRIPTION OF THE INVENTION

The application incorporates by reference U.S. Patent Application No. 61/598,178, entitled "Belt Buckle", filed Feb. 13, 2012 in its entirety.

The present invention is directed to a novel, unique belt buckle design that allows the strap to enter the belt buckle from below (being within the vertical plane relative to the front of the wearer).

The belt buckle design was conceived of during experimentation with a ¼" round steel rod for use making retaining clips meant to hold a glass lens or other objects to ornamental stone lanterns where the glass would cover the actual lamp and fixture, both located in a carved hollow in the stone. Such experimentation made clear the strength and rigidity of this type of rod and brought about the question of its viability as a material supportive of the requirements of a buckle for use in a strapping system or with a belt not of the traditional continuous metal loop connection to the strap or belt but rather of a connection (at the point of permanent connection to the strap) emerging on only one side of said strap or belt, leaving one side of the buckle open (perpendicular to the strap or belt.)

Such an open sided buckle, upon experimentation and use proving structurally viable, also proved functionally superior to closed loop buckles as the open sided buckle design allows for the strap to be slid into the buckle at any point along the strap prior to engagement. This feature eliminates the need to insert the end of the strap through the buckle and pull its unused excess length through the buckle before reaching the needed point of engagement on the strap or belt.

Figure 1:
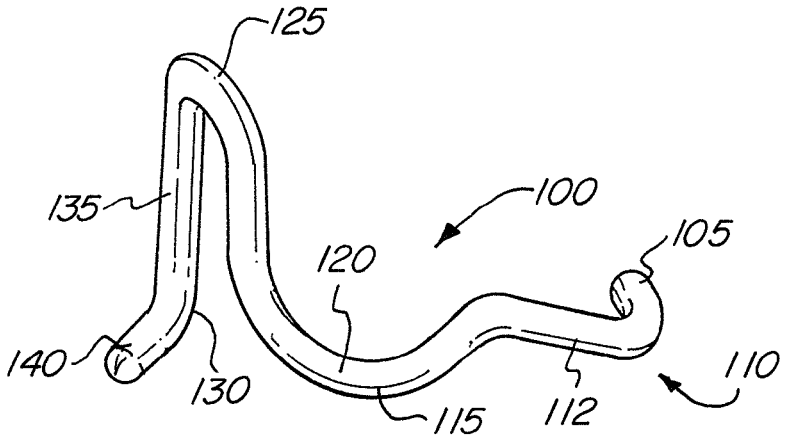
FIG. 1 is a perspective view of a buckle member of an embodiment of the invention.

Referring to FIG. 1, the buckle 100 is shown. The buckle 100 has a proximal section 130, middle section 120 and distal section 110. The proximal section 130 has a hook region 140 that provides support for the distal end of the strap 150.

The proximal section 130 has a body 135 that hooks into a bend 125 leading to the middle section 120 of the buckle 100. In certain embodiments, the hook region 140 is perpendicular to the body 135. The middle section 120 has a body 115 that is bent in a curved C shape, which is open. The C shape can have a convex or concave shape, but is shown as being concave in FIG. 1.

The middle section 120 then leads to the distal section 110 of the buckle 100. The distal section has a body 112 that ends in a hook region 105. The hook region 105 is able to engage with the strap 150.

Figure 2:
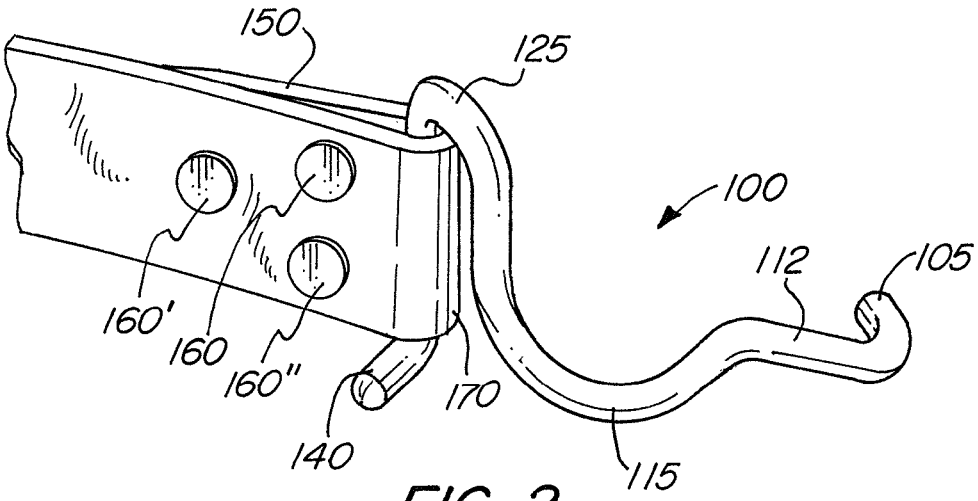
FIG. 2 is a perspective view of the buckle member of FIG. 1 engaged with a strap.

In the embodiment shown in FIG. 2, the buckle 100 is shown with a permanent connection to the belt strap 150. The buckle hook region 140 and body 135 of the proximal section 130 of the buckle 100 are attached to the proximal end of the strap 150 having an engagement region 170 such that the body 135 passes through the engagement region 170 of the strap 150. The engagement region 170 engages the body 135 and hook region 140 of the buckle 100. The hook region 140 appears to be below the belt strap 150 and may support the strap 150.

The hook region 140 is shown having a right angle bend with body region 135 of the proximal section 130 of the buckle 100. The buckle then has a curve 125 on a ¼" radius 180 degrees, 45 degrees from the plane of the initial bend to enter a larger ½" radius semicircular curve 115 of the middle section 120 belt buckle 100. The curve 115 is the body of the middle section 120 of the buckle 100. This curve 115 terminates with another bend 112 away from the previous bends center point, which sends the belt buckle 110 in a direction parallel to the center line of the strap 150. After approximately one inch a sharp 105 degree bend is formed in the direction of the strap 150 and the buckle ends after half an inch in the hook region 105. That last half inch (portion of hook region 105) may be reduced to 5⁄32" and slightly round toward the body of the buckle to cause effective engagement with a hole 155 punched in strap 150.

Aside from the side access feature of said buckle, its form also maximizes control of the excess strap after the point of connection through a punched hole in the strap curve 115 keeps the strap from rising away from the buckle and hook region 140 serves to keep the strap from sliding out from under curve 115 when the tolerances are adjusted appropriately in consideration of the thickness and width of strapping used. An ideal adjustment will keep the excess strapping, beyond the point of engagement that flows back through the buckle, from falling out of the open side of the buckle while allowing the user to still easily disengage the strap from the buckle by flexing the strap enough to move it beyond those buckle features that will hold it secure when engaged. Appropriate adjustment assumes the tolerances will maximize security in the engaged position while not causing difficulty or damage to the strap while being disengaged.

This design has application potential in the fashion realm as an accessories item, and in the industrial market as a quick cinching light duty buckle for a strapping system for tarps, light loads, etc.

FIG. 2 also shows various buttons 160, 160' and 160" that can be attached to the strap via various attachment mechanisms.

Figure 3:
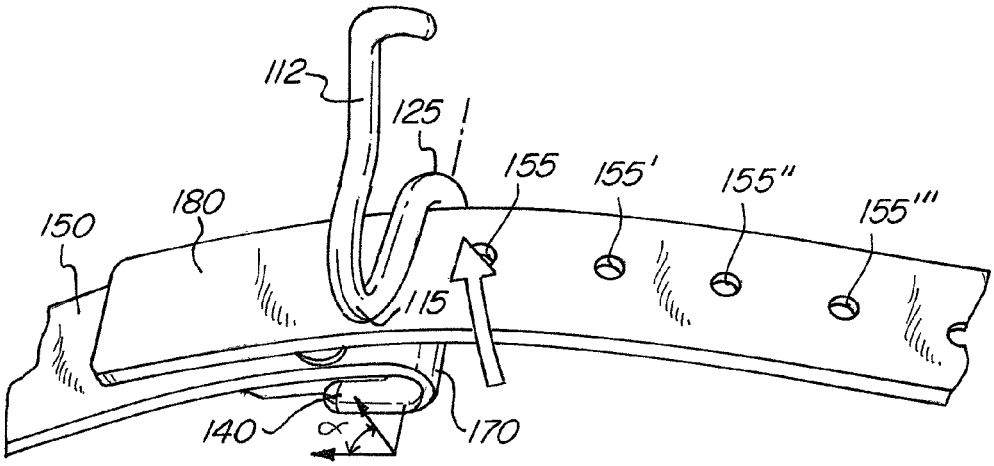
FIG. 3 is a perspective view of the buckle member of FIG. 1 engaged with the strap prior to tightening the strap.

FIG. 3 shows the buckle 100 in an open arrangement such that the buckle 100 is arranged perpendicular to the strap 150. This allows for the strap 150 to be slid into the buckle. The proximal hook region 140 in this arrangement is shown parallel with the strap 150.

Figure 4:
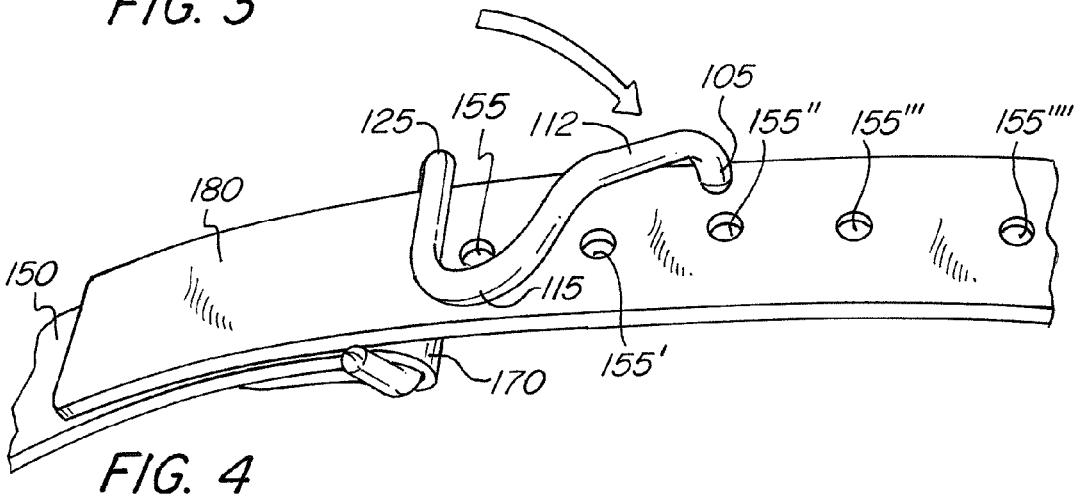
FIG. 4 is a perspective view of the buckle member of FIG. 1 engaged with the strap after tightening the strap.

FIG. 4 shows belt buckle 100 in engagement with the strap 150 after the buckle 100 is rotated with respect to the strap 150 to the closed position. FIG. 4 shows the buckle 100 having a hook section 140, and curve 125, body 115 and body 112. The buckle 100 fits to hold the distal end 180 of the belt to the proximal end 150 of the belt. FIG. 4 also shows the belt strap 150 having holes 155 and 155'.

To engage the distal end of the belt 150 with the buckle 100, a user slides the distal end of the belt across the buckle, but within the space between hook 140 and middle section 120 having body 115 of the belt strap. FIG. 4 shows the buckle 100 engaged with the strap 150 after tightening the strap.

Figure 5:
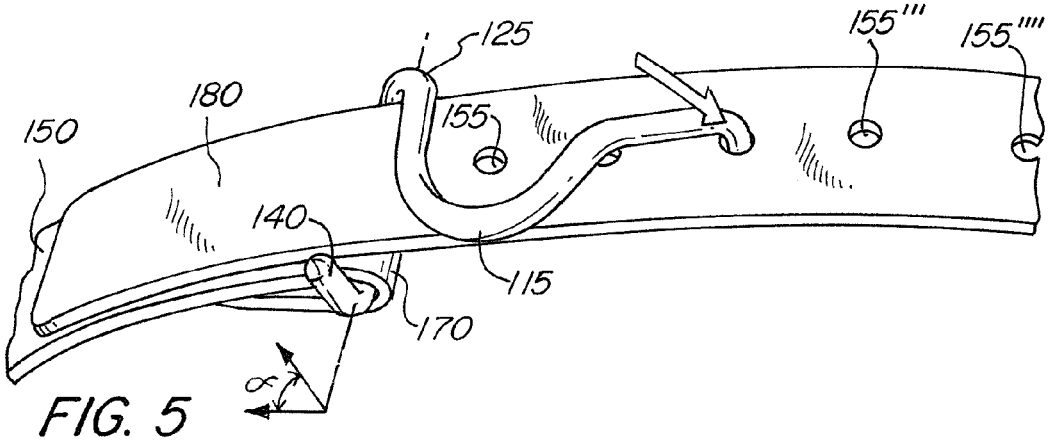
FIG. 5 is a perspective view of the buckle member of FIG. 1 engaged with the strap after to tightening the strap and engaging the buckle member with the strap.

FIG. 5 shows the hook region 105 engaged with the hole 155 of the belt strap 150, so that the buckle member 100 is engaged in the strap 150 in the closed position. This causes the distal end 180 and proximal end 170 of the belt strap 150 to be engaged with one another. The belt strap fits between the hook region 140 and curve 125 of the middle section 120 of the belt strap 150. The middle section 120 of buckle 100 holds the belt strap between the body 135 of the proximal section 130 and the middle section 120 of buckle 100. The arrow shows the movement of the buckle 100 as it rotates along angle γ as the buckle 100 rotates within the engagement region 170 of the strap.

In other embodiments, the belt strap 150 may be rotated so that the hook region 140 is shown above the belt strap 150.

Figure 6:
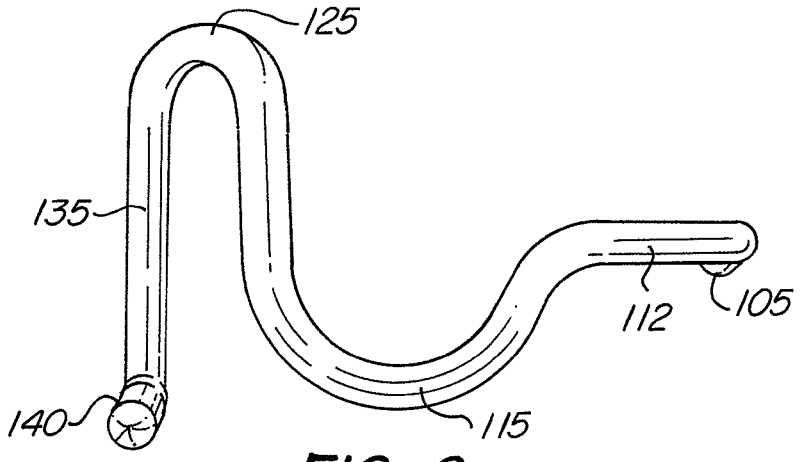
FIG. 6 is a front view of the buckle member of FIG. 1.
Figure 7:
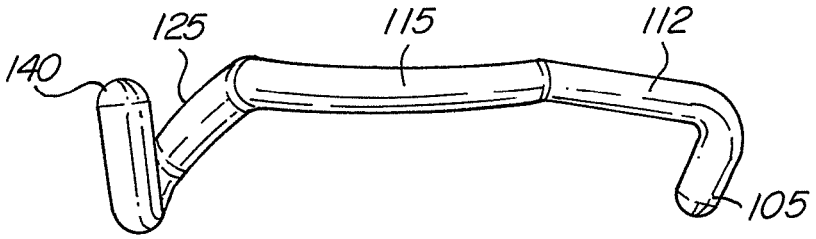
FIG. 7 is a top view of the buckle member of FIG. 1.
Figure 8:
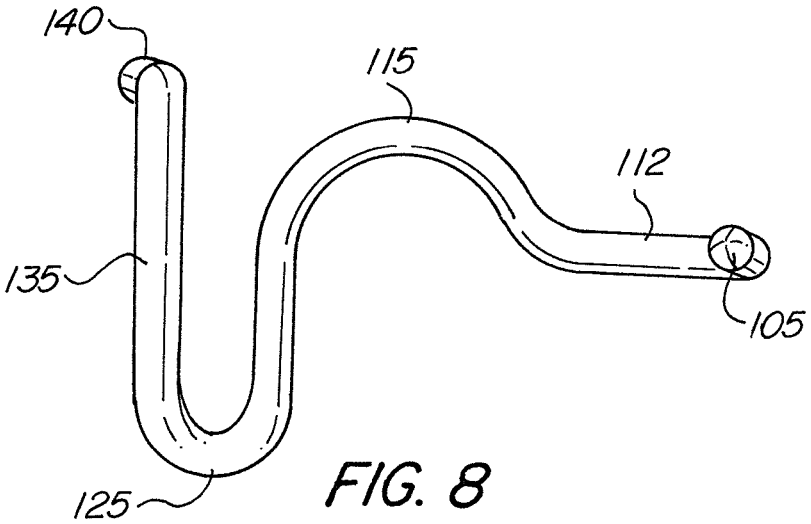
FIG. 8 is a rear view of the buckle member of FIG. 1.

FIGS. 6-8 show perspective views of the belt buckle 100 from various angles. FIG. 6 is a front view of the buckle member of FIG. 1, FIG. 7 is a top view of the buckle member of FIG. 1 and FIG. 8 is a rear view of the buckle member of FIG. 1. In these views hook region 140, body 135, curve 125, body 115, body 112 and hook region 105 are shown.

Figure 9A:
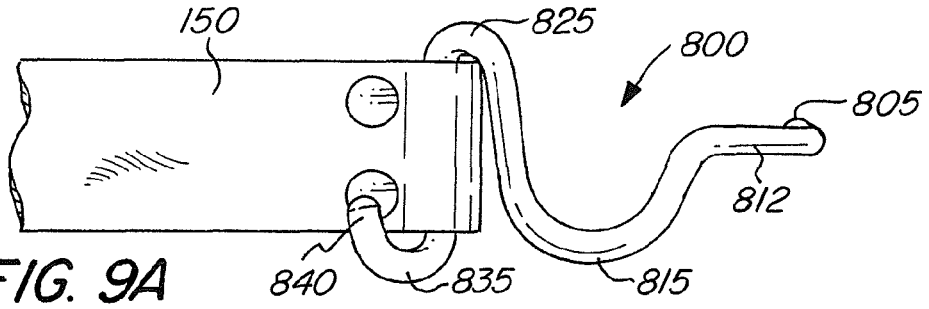
FIG. 9A is a perspective view of a buckle member engaged with a strap of an embodiment of the invention.
Figure 9B:
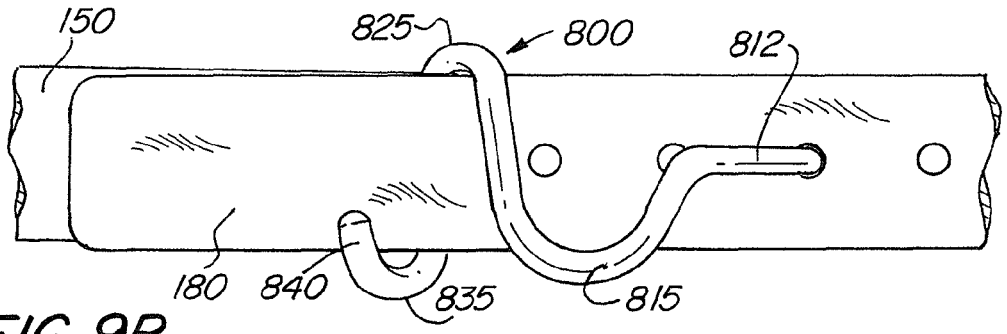
FIG. 9B is a perspective view of the buckle member of FIG. 9A fully engaged with the strap.

FIGS. 9A-9B show belt buckle 800 of another embodiment of the invention. Here, the hook region 840, body 835 and hook region 825 make up the proximal section of the belt buckle. The middle section of the belt buckle 800 is shown as body 815, while the distal end of the belt buckle has body 812 and hook region 805. FIG. 9B shows the belt strap 150 engaged with buckle 800 having the distal end 180 of the strap 150 engaged with the belt buckle 800.

Figure 10A:
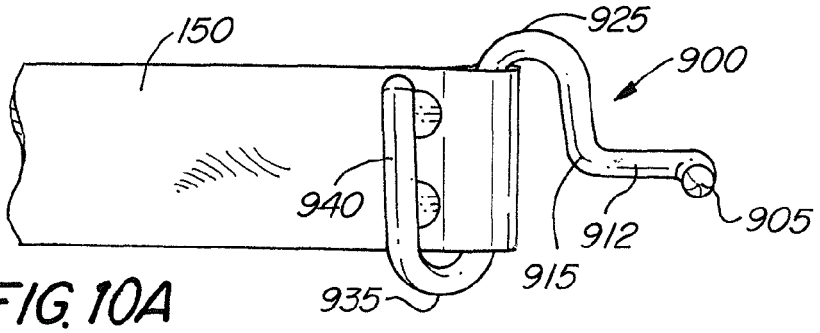
FIG. 10A is a perspective view of a buckle member engaged with a strap of an embodiment of the invention.
Figure 10B:
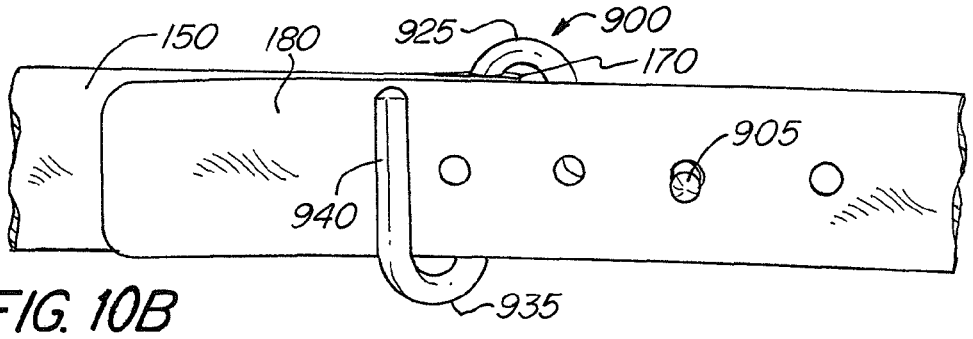
FIG. 10B is a perspective view of the buckle member of FIG. 10A fully engaged with the strap.

FIG. 10A-10B show belt buckle 900 of another embodiment of the invention. Here, the hook region 940, body 935 and hook region 925 make up the proximal section of the belt buckle. The middle section of the belt buckle 900 is shown as body 915, while the distal end of the belt buckle has body 912 and hook region 905. FIG. 10B shows the belt strap 150 engaged with buckle 900 having the distal end 180 of the strap 150 engaged with the belt buckle 900.

Other designs involve proximal, middle sections and distal sections of the belt buckle where the radius of curvature and the length of these sections are varied. These designs allows for straps of various widths to be used with the rod. In certain designs the proximal or distal sections of the belt may be extended.

The designs show the rod being in one piece and having the proximal section of the rod pass through an engagement section in the proximal end of the strap. This engagement section can simply be the strap reversed upon itself 180 degrees and secured, forming a region for the rod to pass through.

Figure 11A:
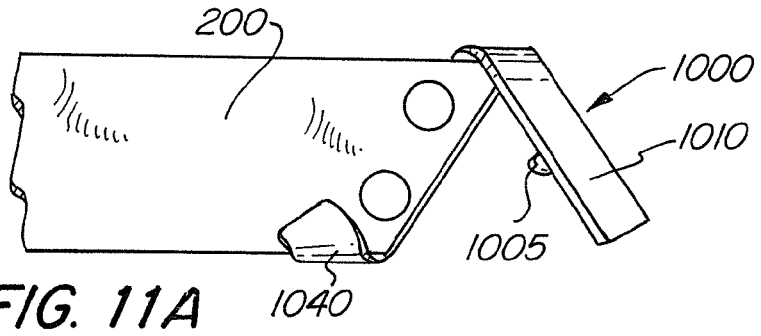
FIG. 11A is a perspective view of a buckle member of an embodiment of the invention.
Figure 11B:
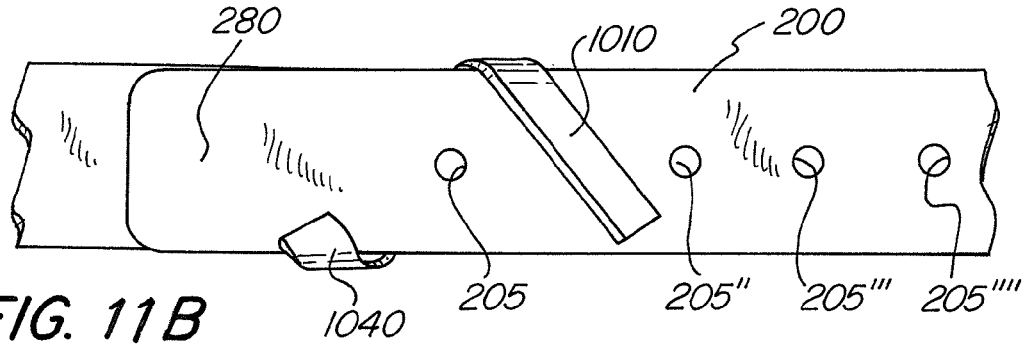
FIG. 11B is a perspective view of the buckle member of FIG. 11A engaged with a strap.
Figure 11C:
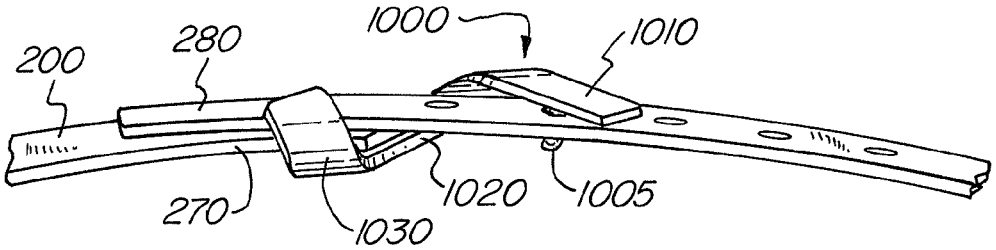
FIG. 11C is a side view of the buckle member of FIG. 11A engaged with a strap.

FIG. 11A-11C show belt buckle 1000 of another embodiment of the invention. FIG. 11B shows belt strap 200 engaged with buckle 1000. Buckle 1000 has a hook region 1040 engaging the proximal end of the belt strap 2000. Buckle 1000 has a body that has a proximal section 1030, middle section 1020 and distal section 1010. The distal section 1010 has a hook region 1005 for engagement with the belt. FIGS. 11B and 11C show buckle 1000 engaged with the belt strap having the distal end 280 of the belt strap 200 between the proximal end section 1030 and distal section 1010 of buckle 1000.

Figure 12:
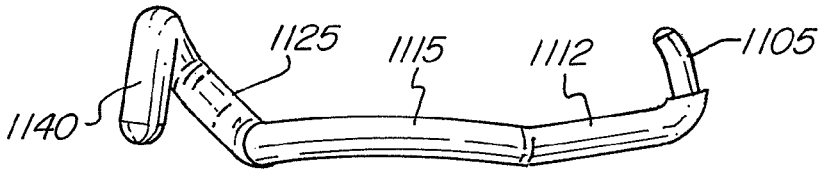
FIG. 12 is top view of the buckle member of FIG. 1 having a tapered end.

FIG. 12 shows the belt buckle of FIG. 1 reproduced, so that the buckle has a hook region 1140, curve 1125, body 1115, body 1112 and hook region 1105. Hook region 1105 has a smaller diameter than the rest of the rod body. In certain embodiments, hook region 1105 may be tapered and/or curved, so that it can interact with holes or bores in the belt strap.

Figure 13:
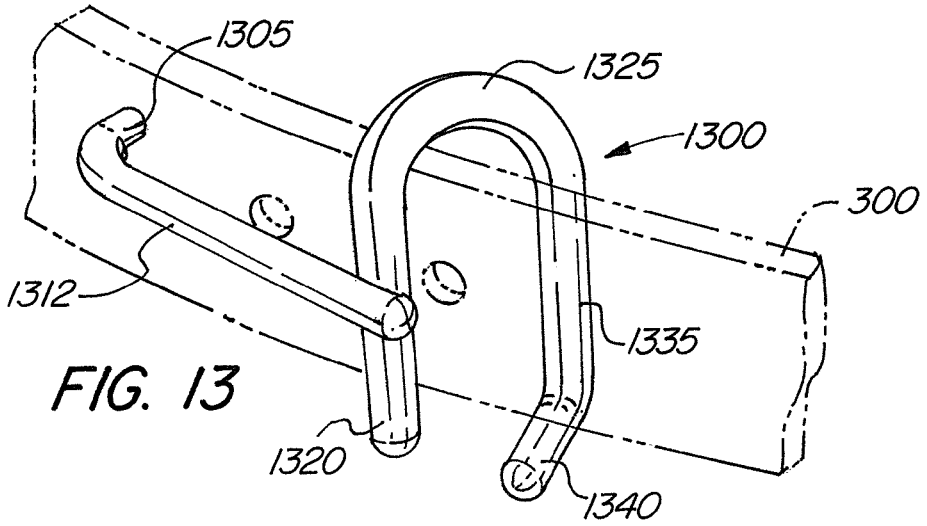
FIG. 13 is a perspective view of a buckle member of an embodiment of the invention engaged with a strap.
Figure 14:
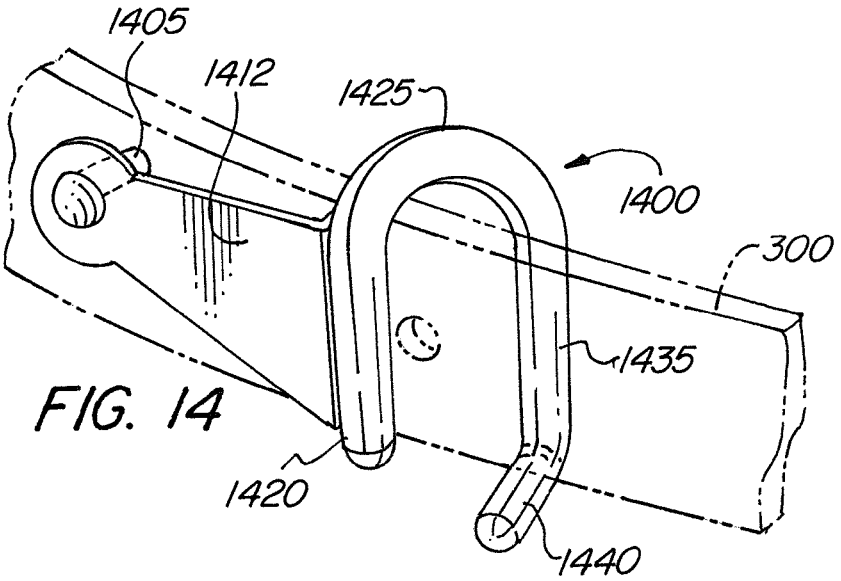
FIG. 14 is a perspective view of a buckle member of an embodiment of the invention engaged with a strap.
Figure 15:
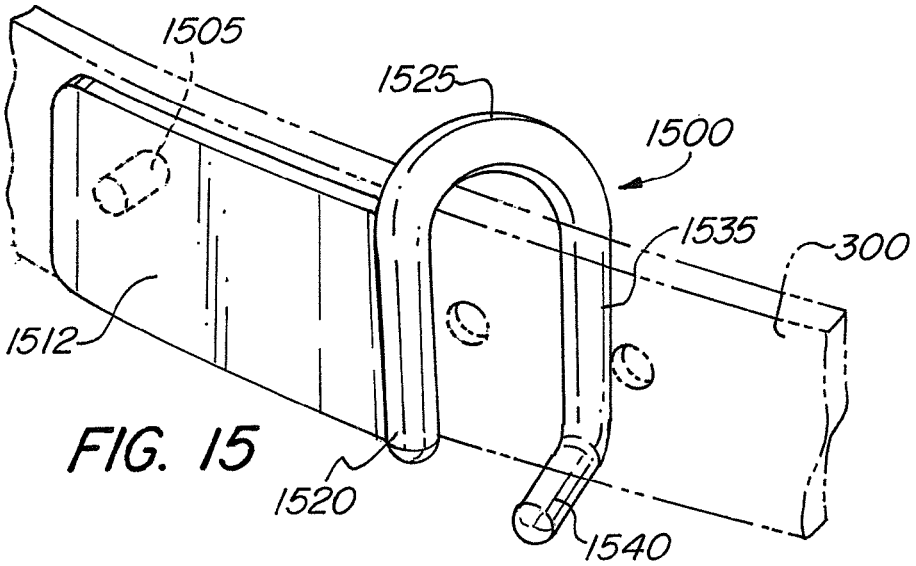
FIG. 15 is a perspective view of a buckle member of an embodiment of the invention engaged with a strap.

FIGS. 13-15 show other embodiments of a buckle of the present invention. FIG. 13 shows the buckle 1300 engaged with strap 300. Buckle 1300 has a hook region 1340 attached to body 1335. The body 1335 passes from the back of the strap 300 to the front of the strap 300 after passing through curve 1325. After passing curve 1325 the buckle continues with body 1320. Body 1320 is then engaged with the distal region 1312 of the buckle 1300. The distal region 1312 is engaged with a hole in the strap by hook 1305.

FIG. 14 shows the buckle 1400 engaged with strap 300. Buckle 1400 has a hook region 1440 attached to body 1435. The body 1435 passes from the back of the strap 300 to the front of the strap 300 after passing through curve 1425. After passing curve 1425 the buckle continues with body 1420. Body 1420 is then engaged with the distal region 1412 of the buckle 1400. The distal region 1412 is engaged with a hole in the strap by hook 1405. The distal region 1412 is tapered along the front of the strap 300.

FIG. 15 shows the buckle 1500 engaged with strap 300. Buckle 1500 has a hook region 1540 attached to body 1535. The body 1535 passes from the back of the strap 300 to the front of the strap 300 after passing through curve 1525. After passing curve 1525 the buckle continues with body 1520. Body 1520 is then engaged with the distal region 1512 of the buckle 1500. The distal region 1512 is engaged with a hole in the strap by hook 1505. The distal region 1512 is rectangular and extends along the front of strap 300.

Buckle members 1300, 1400 and 1500 are able to rotate from an open to a closed position to engage the buckle. In certain embodiments, the buckle member is of a one piece rod like design that passes from the back of the strap to the front of the strap and is connected to a distal region that passes along the front of the buckle. The distal region that passes along the front of the buckle can have various designs.

In certain embodiments, the body 1335, body 1435 and body 1535 pass through an engagement region of the strap, similar to body 135 passing through engagement region 170 as shown in FIG. 2. In certain embodiments, the body 1335, body 1435 and body 1535 are welded together with distal regions 1312, 1412 and 1512 respectively.

In certain embodiments of the invention, the design allows for straps of various widths to be used with the rod. The design shows the rod being in one piece and having the proximal section of the rod pass through an engagement section in the proximal end of the strap. This engagement section can simply be the strap reversed upon itself 180 degrees and secured, forming a region for the rod to pass through.

Figure 16:
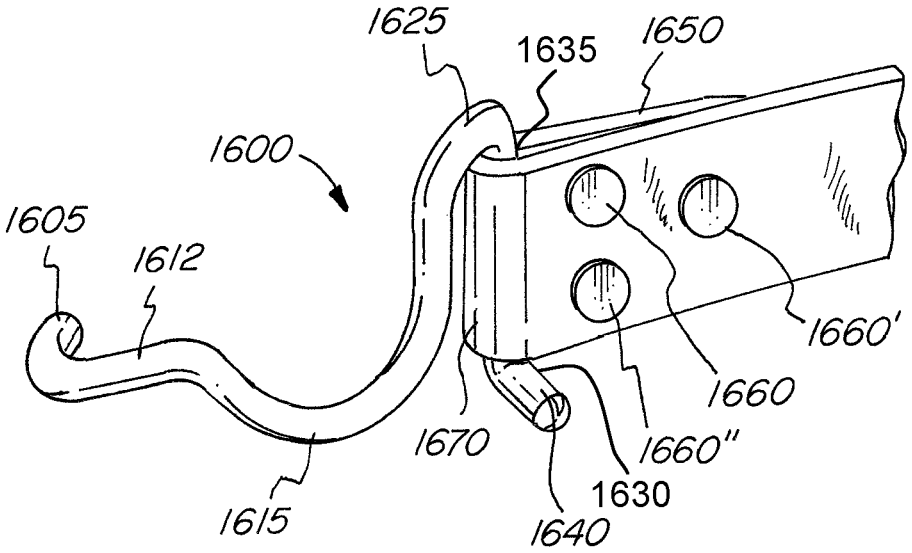
FIG. 16 is perspective view of a buckle member engaged with a strap closing from left to right.

FIG. 16 shows buckle member 1600 engaged with strap 1650. Buckle member 1600 is shown with a permanent connection to the belt strap 1650. The buckle hook region 1640 and body 1635 (partially blocked by the engagement region 1670) of the proximal section 1630 of the buckle 1600 are attached to the proximal end of the strap 1650 having an engagement region 1670 such that the body 1635 passes through the engagement region 1670 of the strap 1650. The engagement region 1670 engages the body 1635 and hook region 1640 of the buckle 1600. The hook region 1640 appears to be below the belt strap 1650 and may support the strap 1650. The buckle 1600 has a curve 1625 which is connected to a semicircular curve 1615 of the middle section of the buckle 1600. The curve 1615 terminates with another bend 1612 away from the previous bends center point. The bend 1612 is further connected to a hook region 1605 FIG. 16 also shows various buttons 1660, 1660' and 1660" that can be attached to the strap via various attachment mechanisms.

FIG. 16 is similar to FIG. 2 but is closed from left to right across the front of the strap. FIG. 2 shows the belt buckle being closed from right to left along the strap. The disclosure includes having belt buckles that open from both left to right and right to left and is not limiting to either orientation. In certain embodiments, different chiral orientation and mirror images of the belt buckles may be contemplated. In certain embodiments, the belt may be worn upside down in a reverse manner to that shown in the figures.

In certain embodiments, the hook regions of the buckle can have a smaller diameter than the rest of the rod. In certain embodiments, the hook regions of the buckle can have a greater diameter than the rest of the rod that makes up the buckle.

In certain embodiments, the buckle has a proximal section attached to the distal end of a strap and a distal section passing around the distal end of a strap and engaging with a hole in the distal end of the strap.

In certain embodiments, the distal end of the strap is engaged with the belt buckle or rod. The belt buckle design may be both in an open position and closed position where the rod is engaged with the strap.

The belt and belt buckle may be used for other purposes, such as a quick engaging tie-down strap to control a load or a tarp, or a buckle on a shoe or bag. In these purposes, where load size may vary greatly, the advantage of engaging the buckle anywhere along the strap without having to feed the length of strap through the buckle prior to engagement becomes apparent.

While the invention has been specifically described in connection with certain specific embodiments thereof, it is to be understood that this is by way of illustration and not of limitation and that various changes and modifications in form and details may be made thereto, and the scope of the appended claims should be construed as broadly as the prior art will permit.

The description of the invention is merely exemplary in nature, and thus, variations that do not depart from the gist of the invention are intended to be within the scope of the invention. Such variations are not to be regarded as a departure from the spirit and scope of the invention.

What is claimed is:

1. A belt comprising:

a strap, the strap comprising a proximal end and a distal end, the proximal end of the strap having an engagement region and the distal end of the strap having at least one hole, the strap having a front side and a back side; and a buckle member, the buckle member being formed and having a proximal section, a middle section and a distal section, the proximal section of the buckle member passing through the engagement region of the proximal end of the strap to engage the buckle member to the strap, the proximal section of the buckle member having a hook region that provides support for the distal end of the strap, the middle section of the buckle member being formed, the middle section of the buckle member passing around the distal section of the strap from the back region of the strap to the front region of the distal end of the strap, and the distal section of the buckle member passing in the front region of the distal end of the strap, the distal section of the buckle member engaging the at least one hole on the distal end of the strap;

wherein the hook region in the proximal section of the buckle member has a right angle bend, wherein the hook region, when the buckle is engaged, passes below the distal section of the strap from the back region of the distal end of the strap to the front region of the distal end of the strap.

2. The belt of claim 1, wherein the distal end of the strap enters the buckle member from below.

3. The belt of claim 1, wherein the distal end of the strap is held in place by the middle section of the buckle member and the proximal section of the buckle member.

4. The belt of claim 3, wherein the hook region in the proximal section of the buckle member exerts an upward force on the distal end of the strap, and wherein the middle section of the buckle member passing around the distal section of the strap from the back region of the strap to the front region of the strap provides a force on the distal end of the strap to hold the distal end of the strip in place.

5. The belt of claim 1, wherein the remainder of the proximal section of the buckle member passes through the engagement region at the proximal end of the strap.

6. The belt of claim 5, wherein the middle section of the buckle member passes from the back region of the distal end of the strap to the front region of the distal end of the strap on a radius of 180 degrees.

7. The belt of claim 6, wherein the middle section of the buckle member passes 45 degrees from the plane of the initial right angle bend in the proximal section of the buckle member.

8. The belt of claim 7, wherein the remainder of the middle section of the buckle member is formed so that it passes in the front region of the distal end of the strap in a manner to provide sufficient force towards the face of the distal end of the strap to prevent the strap from moving away from the body of the wearer or slipping over the right angle hook at the end of the proximal section of the buckle when buckle is engaged.

9. The belt of claim 8, wherein the middle section of the buckle comprises a radius semicircular curve that terminates with another bend away from the middle section of the buckle, which sends the distal section of the buckle member in a direction parallel to the center line of the distal end of the strap.

10. The belt of claim 9, wherein the distal section of the buckle member has a 105 degree bend formed in the direction of the front of the strap, the distal section of the buckle member having a hook to engage the at least one hole in the distal end of the strap.

11. The belt of claim 1, wherein the distal end of the strap has a plurality of holes.

12. The belt of claim 1, wherein the buckle member is made from a metal or a metal alloy.

13. The belt of claim 1, wherein the distal section of the buckle member has a tip with decreasing diameter, or a non-decreasing diameter.

14. The belt of claim 1, wherein the distal end of the strap can be slid into the buckle member at any point along the strap prior to engagement.

15. A belt comprising:

a strap, the strap comprising a proximal end and a distal end, the proximal end of the strap having an engagement region and the distal end of the strap having at least one hole, the strap having a front side and a back side; and a buckle member, the buckle member being formed and having a proximal section, a middle section and a distal section, the proximal section of the buckle member passing through the engagement region of the proximal end of the strap to engage the buckle member to the strap, the proximal section of the buckle member having a hook region that provides support for the distal end of the strap, the middle section of the buckle member being formed, the middle section of the buckle member passing around the distal section of the strap from the back region of the strap to the front region of the distal end of the strap, and the distal section of the buckle member passing in the front region of the distal end of the strap, the distal section of the buckle member engaging the at least one hole on the distal end of the strap;

wherein the hook region in the proximal section of the buckle member rotates into an engaged position by attaching the hook at the distal end of the buckle into the one of the at least several holes in the distal end of the strap.

16. The belt of claim 15, wherein the hook region in the proximal section of the buckle member, when the buckle is engaged, is at a position perpendicular to the front surface of the strap, effectively locking the strap into position.

17. A belt comprising:

a strap, the strap comprising a proximal end and a distal end, the distal end of the strap having at least one hole, the strap having a front side and a back side; and a buckle member, the buckle member having a proximal section and a distal section, the proximal section of the buckle member being formed and engaging the buckle member to the strap, the proximal section of the buckle member having a hook region that provides support for the distal end of the strap and having a body passing around the distal section of the strap from the back region of the strap to the front region of the distal end of the strap, and the distal section of the buckle member passing in the front region of the distal end of the strap, the distal section of the buckle member engaging the at least one hole on the distal end of the strap;

wherein the hook region in the proximal section of the buckle member having a right angle bend, wherein the hook region, when the buckle is engaged, passes below the distal section of the strap from the back region of the distal end of the strap to the front region of the distal end of the strap.

18. The belt of claim 17, wherein the distal end of the strap enters the buckle member from below.

19. The belt of claim 17, wherein the distal end of the strap is held in place by the distal section of the buckle member and the proximal section of the buckle member.

20. The belt of claim 19, wherein the hook region in the proximal section of the buckle member exerts an upward force on the distal end of the strap, and wherein the proximal section of the buckle member passing around the distal section of the strap from the back region of the strap to the front region of the strap provides a force on the distal end of the strap to hold the distal end of the strip in place.

21. The belt of claim 17, wherein the hook region rotates into an engaged position by attaching the hook at the distal end of the buckle into the one of the at least several holes in the distal end of the strap.

22. The belt of claim 21, wherein the hook region is perpendicular to the front surface of the strap, effectively locking the strap into position.

23. The belt of claim 17, wherein the distal section of the buckle member is a rod extending in a direction parallel to the center line of the distal end of the strap.

24. The belt of claim 17, wherein the distal section of the buckle member is rectangular and extends extending in a direction parallel to the center line of the distal end of the strap.

25. The belt of claim 17, wherein the distal section of the buckle member is tapered as its passes along the front region of the distal end of the strap.

26. The belt of claim 17, wherein the distal end of the strap can be slid into the buckle member at any point along the strap prior to engagement.

* * * * *